United States Patent [19]

Rasor et al.

[11] B 3,983,423

[45] Sept. 28, 1976

[54] THERMIONIC CONVERTER

[75] Inventors: Ned S. Rasor, Sunnyvale; Edward J. Britt, Cupertino, both of Calif.

[73] Assignee: The United States of America as represented by the United States Energy Research and Development Administration, Washington, D.C.

[22] Filed: Jan. 9, 1975

[21] Appl. No.: 539,746

[44] Published under the second Trial Voluntary Protest Program on February 17, 1976 as document No. B 539,746.

[52] U.S. Cl. ..... 310/4 R

[51] Int. Cl.[2] ..... H01J 45/00

[58] Field of Search ..... 310/41; 321/2; 322/2

[56] References Cited

UNITED STATES PATENTS

| | | | |
|---|---|---|---|
| 2,510,397 | 6/1950 | Hansell | 310/4 |
| 3,021,472 | 2/1962 | Hernquist | 310/4 X |
| 3,238,395 | 3/1966 | Sense | 310/4 |
| 3,239,745 | 3/1966 | Hernquist | 310/4 X |
| 3,267,308 | 8/1966 | Hernquist | 310/4 |
| 3,381,201 | 4/1968 | Angello | 310/4 X |
| 3,470,393 | 9/1969 | Moncorge | 310/4 |
| 3,578,992 | 5/1971 | Paine | 310/4 |

*Primary Examiner*—Donovan F. Duggan
*Attorney, Agent, or Firm*—Dean E. Carlson; Arthur A. Churm; Paul A. Gottlieb

[57] ABSTRACT

A gas-filled thermionic converter is provided with a collector and an emitter having a main emitter region and an auxiliary emitter region in electrical contact with the main emitter region. The main emitter region is so positioned with respect to the collector that a main gap is formed therebetween and the auxiliary emitter region is so positioned with respect to the collector that an auxiliary gap is formed therebetween partially separated from the main gap with access allowed between the gaps to allow ionizable gas in each gap to migrate therebetween. With heat applied to the emitter the work function of the auxiliary emitter region is sufficiently greater than the work function of the collector so that an ignited discharge occurs in the auxiliary gap and the work function of the main emitter region is so related to the work function of the collector that an unignited discharge occurs in the main gap sustained by the ions generated in the auxiliary gap. A current flows through a load coupled across the emitter and collector due to the unignited discharge in the main gap.

7 Claims, 5 Drawing Figures

THERMIONIC CONVERTER

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

The most successful type of thermionic converter to date is the elementary vapor diode converter, which includes two electrodes, the emitter and the collector. The interelectrode space is filled with a vapor such as cesium vapor. A low voltage arc is generated between the two electrodes to provide positive ions necessary to neutralize the space charge effect caused by the electrons moving from the emitter to collector which degrades converter performance. The potential difference across the interelectrode space required to maintain this arc, known as the arc drop, typically, is at least .4 volts. Since this potential difference is directly subtracted from the output voltage of the converter, it greatly reduces the electrical power output. In addition, for the electrodes to generate ions and for the emitter to emit electrons when heated, requires that operating temperatures of the emitter be very high.

Various devices have been attempted to supply sustaining ions by auxiliary means to eliminate the arc drop and allow for operation at low emitter temperatures. For example, a plasmatron employs a third electrode from which an auxiliary arc, maintained by an external power supply, is used to generate the ions for sustaining the main discharge current between the electrodes. A plasmatron suffers from great inefficiency because the net power generated by the converter is reduced by the power requirements of the external power supply, and suffers from being uneconomical because of its complexity due to the need for heating and electrically insulating the third electrode and providing the third electrode with an independent vacuum envelope feedthrough. In addition, plasmatrons require the auxiliary emitter to be placed in the main electrode gap in order to achieve efficient transport of ions into the main electrode gap. Since it is advantageous to operate with small main interelectrode spacing, this requirement makes it difficult to approach optimum operating conditions.

It is therefore an object of this invention to provide an improved gas-filled thermionic converter.

Another object of this invention is to provide an improved means of supplying sustaining ions for the main discharge region of a gas-filled thermionic converter.

Another object of this invention is to provide an improved gas-filled thermionic converter of simple construction and of low operating temperature.

SUMMARY OF THE INVENTION

A gas-filled thermionic converter is provided including a collector and an emitter of two regions with a load coupled across the collector and emitter. One region of the emitter surface is defined as the main emitter region and the other region of the emitter surface is defined as the auxiliary emitter region with the regions in direct electrical contact with each other. The main emitter region is so positioned with respect to the collector that a main gap is formed between them and the auxiliary emitter region is so positioned with respect to the collector that an auxiliary gap is formed between them. Access is provided between the gaps so that ionizable gas within each gap is free to migrate therebetween. With sufficient heat supplied to the emitter to cause the emitter to emit electrons the work function of the auxiliary emitter region is sufficiently greater than the sum of the work function of the collector and the voltage across the load for an ignited discharge to occur in the auxiliary gap, ionizing gas therein. Simultaneously, the work function of the emitter is so related to the work function of the collector that an unignited discharge occurs in the main gap sustained by the ions generated in the auxiliary gap. A current flows in the load due to the unignited discharge in the main gap.

DETAILED DESCRIPTION OF THE PREFERRED EMBODIMENT

Figure 1:
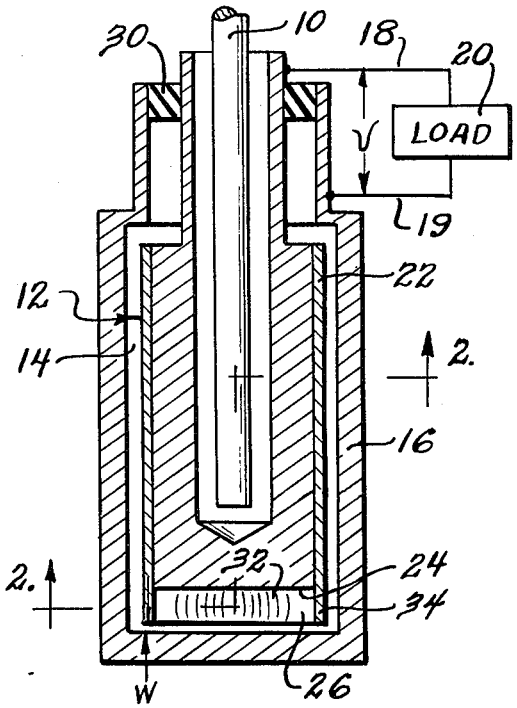
FIG. 1 is a cross section of the improved gas-filled thermionic converter.
Figure 2:
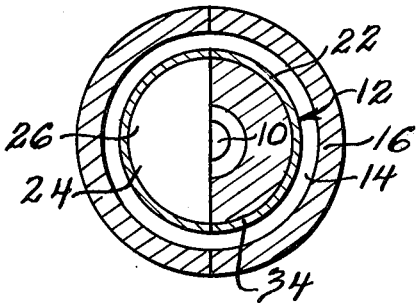
FIG. 2 is a section along line 2—2 of FIG. 1.

Referring to FIG. 1 and FIG. 2, there is shown an improved thermionic converter. The converter includes a heat source 10 which supplies heat to an electrode, the emitter 12, from which electrons are thermionically emitted into the main discharge gap 14. The heat source may be, for example, a nuclear reactor fuel element, hot liquid metal flowing in a tube, or other means able to raise the temperature of emitter 12 to that necessary to cause the emission of electrons. The electrons so emitted move across the main discharge gap 14 towards another electrode, the collector 16 which is at a lower temperature than the emitter 12 since it is not directly heated by heat source 10 and is cooled by a heat sink (not shown). At the collector 16 the electrons condense and return to emitter 12 via electrical leads 18 and 19 and electrical load 20 connected between collector 16 and emitter 12. The flow of electrons from emitter 12 to collector 16 is maintained by the temperature difference between them, which occurs because emitter 12 is being heated by heat source 10. Thus, an electrical current is generated in load 20 by heat applied to emitter 12. This current transport across the main gap 14 is the classical generation of a current from heat applied to emitter; however, it has, as is well known, certain degrading characteristics. The negative electrons crossing the main discharge gap 14 constitute a negative space charge. The current through the converter will be greatly reduced due to the electrostatic effects of this negative space charge. One method of suppressing the negative space charge is to introduce positive ions into main discharge gap 14. These ions are produced through ionization of a vapor. The disclosed device provides an improved means for generating ions for the minimization of the negative space charge.

In particular the disclosed device includes an emitter 12 comprised of two surface regions, defined as the main emitter region 22 and the auxiliary emitter region 24. Each emitter region is composed of a metal and the two emitter regions are in good electrical and thermal contact with each other such as by being in physical contact. Since the two emitter regions are in electrical contact, their Fermi levels are equal and, since they are in thermal contact, their temperatures will be substantially equal.

The main emitter region 22 is positioned adjacent to collector 16 to form main discharge gap 14. The auxiliary emitter region 24 is positioned adjacent the collector 16 to form an auxiliary discharge gap 26. In this embodiment, the formation of gaps 14 and 26 is achieved by emitter 12 being cylindrical. The auxiliary region 24 is one end of a central cylindrical portion of emitter 12 and the main emitter region 22 is the outer surface of a sheath encasing the solid cylinder with the auxiliary region 24. The main region sheath 22 is held in physical contact with the main emitter region cylinder 24 by means such as welding. The end of the solid cylindrical portion forming the auxiliary emitter region 24 is not covered by the main emitter region sheath 22. Collector 16 is in the form of a hollow cylinder with collector material forming at least the inside axial wall and one end of the cylinder. Emitter 12 is held within the hollow, cylindrical collector 16 by insulated sealing plug 30. The outside diameter of emitter 12 is less than the inside diameter of collector 16 so that a circular main gap 14 is formed between main emitter region 22 and the axial wall of cylindrical collector 16. The exposed end of the solid cylinder is the auxiliary emitter region 24 and is positioned separated from the end of cylindrical collector 16 to form auxiliary gap 26. The gaps 14 and 26 are therefore generally partially isolated from each other by the geometry of the emitter and collector. Ionizable gas, such as cesium, is contained within the hollow cylindrical collector 16 and particularly within main gap 14 and auxiliary gap 26 and is free to migrate between gaps 14 and 26. Insulated sealing plug 30 prevents escape of the gas from the device in addition to providing the structural support necessary to maintain the desired positioning of emitter 12 with respect to collector 16.

Figure 3:
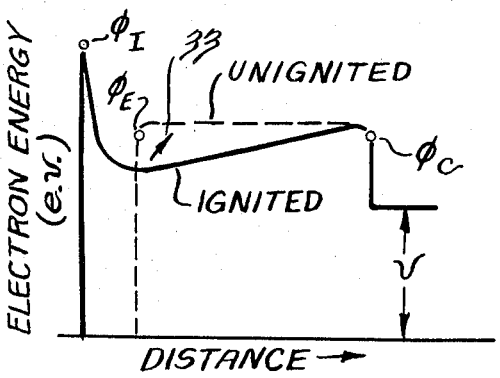
FIG. 3 is a motive diagram of the improved thermionic converter.

The operation of the device is better understood with reference to its motive diagram shown in FIG. 3. $\phi_I$, $\phi_E$ and $\phi_C$ are the respect values of the work functions of auxiliary emitter region 24, the main emitter region 22 and collector 16. In main gap 14 there occurs the classical unignited discharge between a heated emitter and a collector, illustrated by the curve labeled unignited. The operating characteristics of a classical unignited discharge are well known. The voltage V across load 20 is determined by the transport of electrons from the main emitter region 22 to the collector 16 and should be adjusted to give substantially zero arc drop across the main discharge gap 14, i.e., $\phi_E \approx (\phi_C + V)$, as shown in FIG. 3. As $V$ is increased above this zero arc drop condition, the current through load 20 will decrease rapidly with a net decrease in output power, while as $V$ decreases current increases only slightly with a net decrease in output power. Therefore zero arc drop is optimal. The classical unignited discharge in main gap 14, characterized by the thermionic emission of electrons from the main emitter region 22 to the colder collector 16 because of heat supplied to emitter 22 from heat source 10, will be sustained if a supply of ions can be provided to eliminate the negative space charge. As shown in FIG. 3, with $\phi_I$ sufficiently greater than $\phi_E$ (i.e., $V + \phi_C$) an ignited discharge 32 occurs in the auxiliary gap 26 between the auxiliary emitter region 24 and collector 16, as illustrated by the curve labeled ignited. The ignited discharge ionizes gas present in the auxiliary gap 26. It should be noted that the difference between an ignited discharge and an unignited discharge is that in the ignited discharge a certain amount of the gas present will be ionized by the electrons emitted from the emitter surface and in the unignited discharge gas present will not be ionized by emitted electrons. As ions are generated in the auxiliary gap 26, they migrate to the main gap 14 to negate the space charge effect. The ions migrate to the main gap because of the difference in motive between the ignited region and the unignited region as indicated by arrow 33. The ions being positive and at the energy of the ignited curve see a potential energy trough in the unignited curve. It is important that the auxiliary gap be sufficiently isolated from the main gap 14 to prevent too many ions from migrating into the main gap. If too great a migration of ions occur, the auxiliary gap will be drained and will not retain enough ions to sustain the ignited discharge. The auxiliary gap 26 may be partially isolated from the main gap 14 by an extension 34 of the main emitter region sheath 22 past the end of the solid cylindrical auxiliary emitter region 24. This leaves a separation W through which ions migrate from the auxiliary gap 26 to the main gap 14.

To achieve the desired discharges in gaps 14 and 26 requires that the work functions of the emitter and collector follow the relations illustrated in FIG. 3. The work functions of materials are dependent upon known factors which may be manipulated to give the desired relative values. For example, metals in the presence of cesium vapor have work functions dependent upon the temperature of the metal, the pressure of the cesium and the adsorption of the cesium onto the metal surface. To attain the relative work functions for the auxiliary emitter region, the main emitter region and the collector necessary to achieve the ignited discharge in the auxiliary discharge gap and the simultaneous unignited discharge in the main discharge gap 14, those skilled in the art would be able to particularize various combinations of operating temperatures, ionizable gases, other gases, gas pressure, auxiliary emitter material, main emitter material, collector material and gap separations. The types of materials normally used in thermionic converters are applicable here. For example, a cesium filled device conforming to the embodiment illustrated in FIG. 1, and FIG. 2 having a main emitter region of platinum, an auxiliary emitter region of niobium and a collector of stainless steel operating with an emitter temperature of about 1400°K, a collector temperature of 880°K, cesium pressure of .2 Torr, a main discharge spacing between main emitter region 22 and collector 16 of 1 mm, an auxiliary discharge spacing between auxiliary emitter region 24 and collector 16 of 1.5 mm, $V$ of .4 volt, developed an output current of 6 amp/cm$^2$ averaged over the main emitter surface. Under these operating conditions $\phi_E \approx 2.0$ ev, $\phi_C \approx 1.5$ ev and $\phi_I \approx 2.6$ ev giving a main arc drop of about 0 and an auxiliary arc drop of about .6 volt.

An illustration of the selection of desirable operating conditions and materials is given by the following procedure. First, there is a given temperature generated by the heat source 10, which must be sufficient to maintain adequate emission of electrons from an emitter. Emitter temperatures $T_E$ of 1000°K to 2000°K are achievable with a variety of heat sources. A material for the main emitter region is selected to have, at the given emitter temperature, a work function low enough to permit emission of the required electron current to the collector, typically $\phi_E \lesssim T_E/680°K$ ev approximately. Next, there is a given collector temperature $T_C$ which is determined by the available heat sink, being typically 500°K to 1000°K. A collector material is then selected which, at the given collector temperature, has as low a work function as possible, but not so low that excessive back emission of electrons from the collector occurs, degrading converter performance; typically $\phi_C$ $T_C$620°K, ev approximately. The material for the auxiliary emitter region is then selected and must have at the given emitter temperature a work function sufficiently higher than the main emitter region. The work function of the auxiliary emitter region must be slightly higher than the minimum necessary to maintain an ignited discharge between the auxiliary emitter region and the collector, remembering that there is zero arc drop between the main emitter region and the collector under ideal operating conditions. However, as the work function of the auxiliary emitter region is increased above the minimum for an ignited discharge, too few electrons will be emitted to sustain a minimum ion production necessary to sustain the unignited discharge in the main gap. Note that if the work functions are determined by cesium adsorption, as the temperature decreases, the difference in the work functions of the two emitter regions will decrease and the operating conditions of the device will be degraded. Assuming cesium is the gas present its pressure will also effect the work functions and should be considered. Optimum gap widths which influence the ignited and unignited discharge may be determined to be compatible with the materials selected. There is a minimum number of ions generated in the auxiliary gap and migrating to the main gap necessary to sustain the unignited discharge in the main gap. The number of ions transported is determined by the rate of ion production in the auxiliary gap and the degree of isolation of the auxiliary gap from the main gap. The rate of excess ion production in the auxiliary discharge, as has been described, is determined by the difference between the auxiliary emitters region's work function and the main emitter region's work function. The isolation between gaps 14 and 26 is determined by the dimension W, that is the width of the gap separating the two discharge regions which may be varied to give optimal ion migration.

Figure 4:
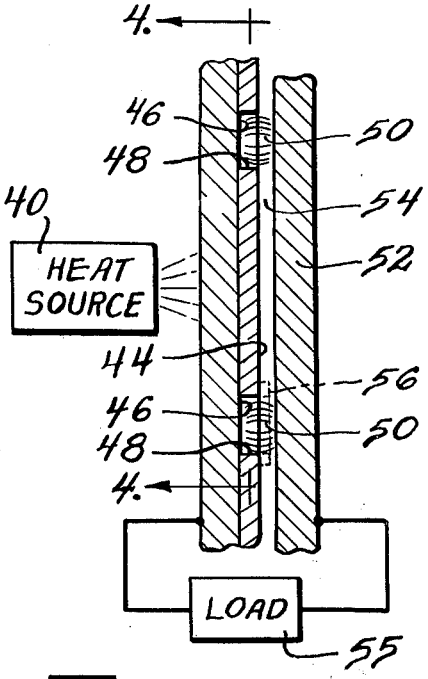
FIG. 4 is an alternate embodiment of the improved thermionic converter.
Figure 5:
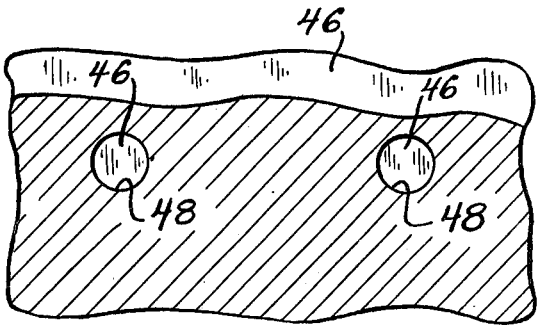
FIG. 5 is a section along line 4—4 of FIG. 4.

Another embodiment of the device is shown in FIG. 4 and FIG. 5. When the configuration shown in FIG. 1 and FIG. 2 is impractical because the electrode size is so great as to preclude sufficient ion distribution from a single auxiliary discharge gap, the emitter structure shown in FIG. 4 and FIG. 5 can be employed. Here heat source 40 supplies heat to the emitter 42 which has two surface regions, defined as the main emitter region 44 and the auxiliary emitter region 46. Each region is formed by parallel planar elements in contact with each other to form a sandwich, a portion of which is shown. Holes are provided in main emitter region 44 to form cavities or auxiliary discharge gaps 48 over the main emitter region 44's surface. The embodiment shown in FIG. 4 and FIG. 5 operates in the same manner as the embodiment shown in FIG. 1 and FIG. 2. The ionizable gas is contained between the emitter 42 and collector 52 in main gap 54 and auxiliary gaps 48. Within each auxiliary gap 48 an ignited discharge 50 is maintained by the contact potential difference between the auxiliary emitter region 46 and collector 52. An unignited discharge occurs in main discharge gap 54 between the main emitter region 44 and collector 52 causing a current to flow in load 55. The number, size and separation of the cavities are governed by the optimum conditions for maintaining the auxiliary discharge and for the efficient distribution of resulting ions. Sufficient isolation of the auxiliary and main discharges can be achieved through optimizing these designed variables along with the main interelectrode spacing. In cases where this optimum condition is too restrictive, it is possible to erect a lip 56 at the opening of each cavity to serve the function of the extension of main emitter region 34 of FIG. 1. The selection of materials and other variables follows the considerations and procedures, previously outlined. The cavities in the emitter of the embodiment shown in FIG. 4 and FIG. 5 could also be distributed over a cylindrical emitter surface and operated in the same manner.

It should be clear from the previous discussion that the structure of the electrodes of the hybrid mode converter is only slightly more complex than that of the elementary diode converter and that no additional external connections or power supply are required. The selection of materials to be used, and optimal operating conditions to give the desired unignited discharge and the simultaneous self-powered ignited discharge in the main discharge gap and the auxiliary discharge gap respectively follow the well known body of experience concerning each of these thermionic discharge modes.

The embodiments of the invention in which an exclusive property or privilege is claimed are defined as follows:

1. A gas-filled thermionic converter for generating a current through a load in response to heat applied to the converter from a heat source, comprising, a collector, an emitter coupled to said collector by the load and having a main emitter surface region so positioned with respect to said collector to form a main gap therebetween and having an auxiliary emitter surface region in direct electrical and thermal contact with said main emitter region so that said regions are at about the same temperature, said auxiliary emitter region being so positioned with respect to said collector to form an auxiliary gap therebetween partially isolated from said main gap with access allowed therebetween, and an ionizable gas within said auxiliary gap and said main gap capable of migrating therebetween, with sufficient heat from the heat source applied to said emitter to cause the emission of electrons therefrom, the work function of said auxiliary emitter region being of such value with respect to the sum of the work function of said collector and the voltage across the load that an ignited discharge occurs between the auxiliary emitter and collector in said auxiliary region and the work function of said main emitter region being of sufficient value with respect to the sum of the work function of said collector and the voltage across the load that an unignited discharge occurs in said main gap simultaneously with the ignited discharge in said auxiliary gap, said ignited discharge ionizing a portion of said ionizable gas so that the resulting ionized gas migrates to said main gap to sustain said unignited discharge.

2. The converter of claim 1 wherein with said sufficient heat applied to said emitter the work function of said main emitter region is less than the work function of said collector and no more than the sum of the work function of said collector and the voltage across said load.

3. The converter of claim 2 wherein with said sufficient heat applied to said emitter the work function of said auxiliary emitter region is only slightly greater than the minimum necessary to maintain an ignited discharge between said auxiliary emitter region and said collector in said auxiliary gap.

4. The converter of claim 3 wherein said collector is a hollow cylinder containing said ionizable gas with one end of said cylinder closed, said main emitter region is the outer surface of a hollow cylindrical sheath whose outside diameter is less than the inside diameter of said cylindrical collector's axial wall, and said auxiliary emitter region is one end of a cylinder encased in said sheath with said auxiliary emitter region uncovered by said sheath, said emitter being positioned within said hollow cylindrical collector with said uncovered auxiliary emitter region separated from and opposite the closed end of said collector to form said auxiliary gap therebetween and with said sheath separated from and opposite the axial inner wall of said cylindrical collector to form said main gap therebetween.

5. The converter of claim 4 wherein said main emitter region cylindrical sheath extends uniformly beyond said exposed auxiliary emitter region to partially isolate said auxiliary gap from said main gap.

6. The converter of claim 3 wherein said auxiliary emitter region is a planar surface, said main emitter region is a planar surface having a hole therethrough and being in contact with said auxiliary emitter region planar surface to form a sandwich, and said collector is a planar surface, said collector being positioned separated from and opposite said main emitter surface so that said auxiliary gap is formed between said collector and said auxiliary emitter region planar surface through said hole in said main emitter region planar surface area so that a main gap is formed between said main emitter region planar surface and said collector planar surface, said ionizable gas being contained in said main gap and said auxiliary gap.

7. The converter of claim 6 wherein said auxiliary emitter region planar surface includes a lip circumscribing said hole and extending beyond said auxiliary emitter region planar surface toward said collector planar surface to partially isolate said auxiliary gap from said main gap.

* * * * *